US006273552B1

(12) United States Patent
Hawkins et al.

(10) Patent No.: US 6,273,552 B1
(45) Date of Patent: Aug. 14, 2001

(54) IMAGE FORMING SYSTEM INCLUDING A PRINT HEAD HAVING A PLURALITY OF INK CHANNEL PISTONS, AND METHOD OF ASSEMBLING THE SYSTEM AND PRINT HEAD

(75) Inventors: Gilbert A. Hawkins, Mendon; Omid A. Moghadam, Pittsford, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/249,191

(22) Filed: Feb. 12, 1999

(51) Int. Cl.[7] ..... B41J 2/14; B41J 2/00
(52) U.S. Cl. ..... 347/48; 347/55
(58) Field of Search ..... 347/44, 48, 55, 347/70, 54, 68, 40, 20

(56) References Cited

U.S. PATENT DOCUMENTS

| | | | | |
|---|---|---|---|---|
| 4,600,928 | | 7/1986 | Braun et al. | 347/28 |
| 4,970,535 | | 11/1990 | Oswald et al. | 347/25 |
| 5,574,485 | | 11/1996 | Anderson et al. | 347/27 |
| 5,598,200 | * | 1/1997 | Gore | 347/54 |
| 5,726,693 | * | 3/1998 | Sharma et al. | 347/48 |
| 5,880,759 | * | 3/1999 | Silverbrook | 347/48 |
| 6,022,099 | | 8/2000 | Chwalek et al. | 347/57 |
| 6,027,205 | * | 2/2000 | Herbert | 347/54 |
| 6,126,270 | | 10/2000 | Lebens et al. | 347/48 |

* cited by examiner

*Primary Examiner*—John Barlow
*Assistant Examiner*—Juanita Stephens
(74) *Attorney, Agent, or Firm*—Walter S. Stevens

(57) ABSTRACT

An image forming method including a print head having plurality of micromachined ink channel pistons, and method of assembling the method and print head. The method comprises a piston for pressurizing an ink body so that an ink meniscus extends from the ink body. An ink droplet separator is also provided for lowering surface tension of the meniscus as the meniscus extends from the ink body. The extended meniscus severs from the ink body to form an ink droplet as the droplet separator lowers the surface tension to a predetermined value.

47 Claims, 12 Drawing Sheets

IMAGE FORMING SYSTEM INCLUDING A PRINT HEAD HAVING A PLURALITY OF INK CHANNEL PISTONS, AND METHOD OF ASSEMBLING THE SYSTEM AND PRINT HEAD

BACKGROUND OF THE INVENTION

This invention generally relates to printing devices and methods, and more particularly relates to an image forming system including a print head having plurality of ink channel pistons, and method of assembling the system and print head.

BACKGROUND ART

Ink jet printing is recognized as a prominent contender in digitally controlled, electronic printing because of its non-impact, low-noise characteristics, use of plain paper and avoidance of toner transfers and fixing. For these reasons, DOD (Drop-On-Demand) inkjet printers have achieved commercial success for home and office use.

For example, U.S. Pat. No. 3,946,398, which issued to Kyser et al. in 1970, discloses a drop-on-demand ink jet printer which applies a high voltage to a piezoelectric crystal, causing the crystal to bend. As the crystal bends, pressure is applied to an ink reservoir for jetting ink drops on demand. Other types of piezoelectric drop-on-demand printers utilize piezoelectric crystals in push mode, shear mode, and squeeze mode. However, patterning of the piezoelectric crystal and the complex high voltage drive circuitry necessary to drive each printer nozzle are disadvantageous to cost effective manufacturability and performance. Also, the relatively large size of the piezo transducer prevents close nozzle spacing making it difficult for this technology to be used in high resolution page width printhead design.

Great Britain Pat. No. 2,007,162, which issued to Endo et al. in 1979, discloses an electrothermal drop-on-demand ink jet printer that applies a power pulse to an electrothermal heater which is in thermal contact with water based ink in a nozzle. A small quantity of ink rapidly evaporates, forming a bubble which causes drops of ink to be ejected from small apertures along an edge of a heater substrate. This technology is known as thermal ink jet printing.

More specifically, thermal ink jet printing typically requires a heater energy of approximately 20 $\mu$J over a period of approximately 2 $\mu$sec to heat the ink to a temperature 280–400° C. to cause rapid, homogeneous formation of a bubble. Rapid bubble formation provides momentum for drop ejection. Collapse of the bubble causes a pressure pulse due to the implosion of the bubble. The high temperatures needed with this device necessitates use of special inks, complicates driver electronics, and precipitates deterioration of heater elements through kogation, which is the accumulation of ink combustion by-products that encrust the heater with debris. Such encrusted debris interferes with thermal efficiency of the heater. In addition, such encrusted debris may migrate to the ink meniscus to undesirably alter the viscous and chemical properties of the ink meniscus. Also, the 10 Watt active power consumption of each beater prevents manufacture of low cost, high speed pagewidth printheads.

An inkjet printing system is disclosed in commonly assigned U.S. patent application Ser. No. 08/621,754 filed on Mar. 22, 1996, in the name of Kia Silverbrook. The Silverbrook device provides a liquid printing system incorporating nozzles having a meniscus poised at positive pressure extending from nozzle tip. A heater surrounding the nozzle tip applies heat to the edge of the meniscus. This technique provides a drop-on-demand printing mechanism wherein the means of selecting drops to be printed produces a difference in position between selected drops and drops which are not selected. However, the difference in position is insufficient to cause ink drops to overcome surface tension and separate from the body of ink. In this regard, separation means is provided to cause separation of the selected drops from the body of ink. However, this method of selection that uses surface tension reduction requires specialized inks and the requirement of poising the meniscus at a positive pressure may cause undesirable nozzle leakage due to contamination on any single nozzle. Application of an electric field or the adjustment of receiver proximity is thereafter used to cause separation of the selected drops from the body of the ink. However, the electric field strength needed to separate the selected drop is above the value for breakdown in air so that a close spacing between nozzle and receiver is needed, but there is still the possibility of arcing. Also, causing separation of the drop using proximity mode, for which the paper receiver must be in close proximity to the orifice in order to separate the drop from the orifice, is unreliable due to the presence of relatively large dust particles typically found in an uncontrolled environment.

Another inkjet printing system is disclosed in commonly assigned U.S. patent application Ser. No. 09/017,827 filed Feb. 3, 1998, in the name of John Lebens et al. The Lebens, et al. device provides an image forming apparatus incorporating an ink jet printhead where a single transducer is used to periodically oscillate the body of ink in order to poise ink drops and form a meniscus. The Lebens device further comprises an ink drop separator associated with the transducer for lowering the surface tension of the meniscus in order to separate the meniscus from the ink body to form an ink droplet. Although the Lebens, et al. device operates satisfactorily for its intended purpose, use of the Lebens et al. device may nonetheless lead to propagation of unwanted pressure waves in an ink manifold belonging to the printhead. These unwanted pressure waves in the ink manifold can in turn lead to inadvertent ejection of drops. Therefore, it is desirable to localize the effects of the pressure to the ink cavities and their respective nozzles.

Therefore, there remains a long-felt need for an ink jet printer providing such advantages as reduced cost, increased speed, higher print quality, greater reliability, less power usage, and simplicity of construction and operation.

SUMMARY OF THE INVENTION

An object of the present invention is to provide an image forming system and method for forming an image on a recording medium, the system including a thermo-mechanically activated DOD (Drop On Demand) printhead including a DOD print head having a plurality of ink channel pistons, and method of assembling the system and print head.

With this object in view, the invention resides in an image forming system, comprising a piston adapted to momentarily pressurize an ink body so that an ink meniscus extends from the ink body, the meniscus having a predetermined surface tension; and an ink droplet separator associated with said piston for lowering the surface tension of the meniscus while the meniscus extends from the ink body, whereby said droplet separator separates the meniscus from the ink body to form an ink droplet while the surface tension lowers.

According to an embodiment of the present invention, the system includes a printhead defining a plurality of ink channels in the print head. Each channel holds an ink body therein and terminates in a nozzle orifice. A micromachined piston is disposed in each channel for alternately pressurizing and depressurizing the ink body. An ink meniscus extends from the ink body and out the nozzle orifice while the ink body is pressurized. In addition, the ink meniscus retracts into the nozzle orifice while the ink body is depressurized. An ink droplet separator is also provided for lowering surface tension of the meniscus as the meniscus extends from the orifice. The extended meniscus severs from the ink body to form an ink droplet as the droplet separator lowers the surface tension to a predetermined value.

A feature of the present invention is the provision of a single micromachined array of pistons in fluid communication with a plurality of ink meniscis reposed at respective ones of a plurality of nozzles for pressurizing the meniscis, so that the menisci extend from the nozzles as the menisci are pressurized and retract into the nozzles as the menisci are depressurized.

Another feature of the present invention is the provision of a plurality of heaters in heat transfer communication with respective ones of the ink menisci, the heaters being selectively actuated only as the meniscus extend a predetermined distance from the nozzles for separating selected ones of the menisci from their respective nozzles.

Another advantage of the present invention is that use thereof increases reliability of the printhead.

Another advantage of the present invention is that use thereof conserves power.

Yet another advantage of the present invention is that the heaters belonging thereto are longer-lived.

A further advantage of the present invention is that use thereof allows more nozzles per unit volume of the printhead to increase image resolution.

An additional advantage of the present invention is that use thereof allows faster printing.

Still another advantage of the present invention is that a vapor bubble is not formed at the heater, which vapor bubble formation might otherwise lead to kogation.

Yet another advantage of the present invention is that use thereof reduces propagation of unwanted pressure waves in the ink manifold of the printhead, which reduced propagation in turn reduces risk of inadvertent ejection of drops.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figures 1, 1A:
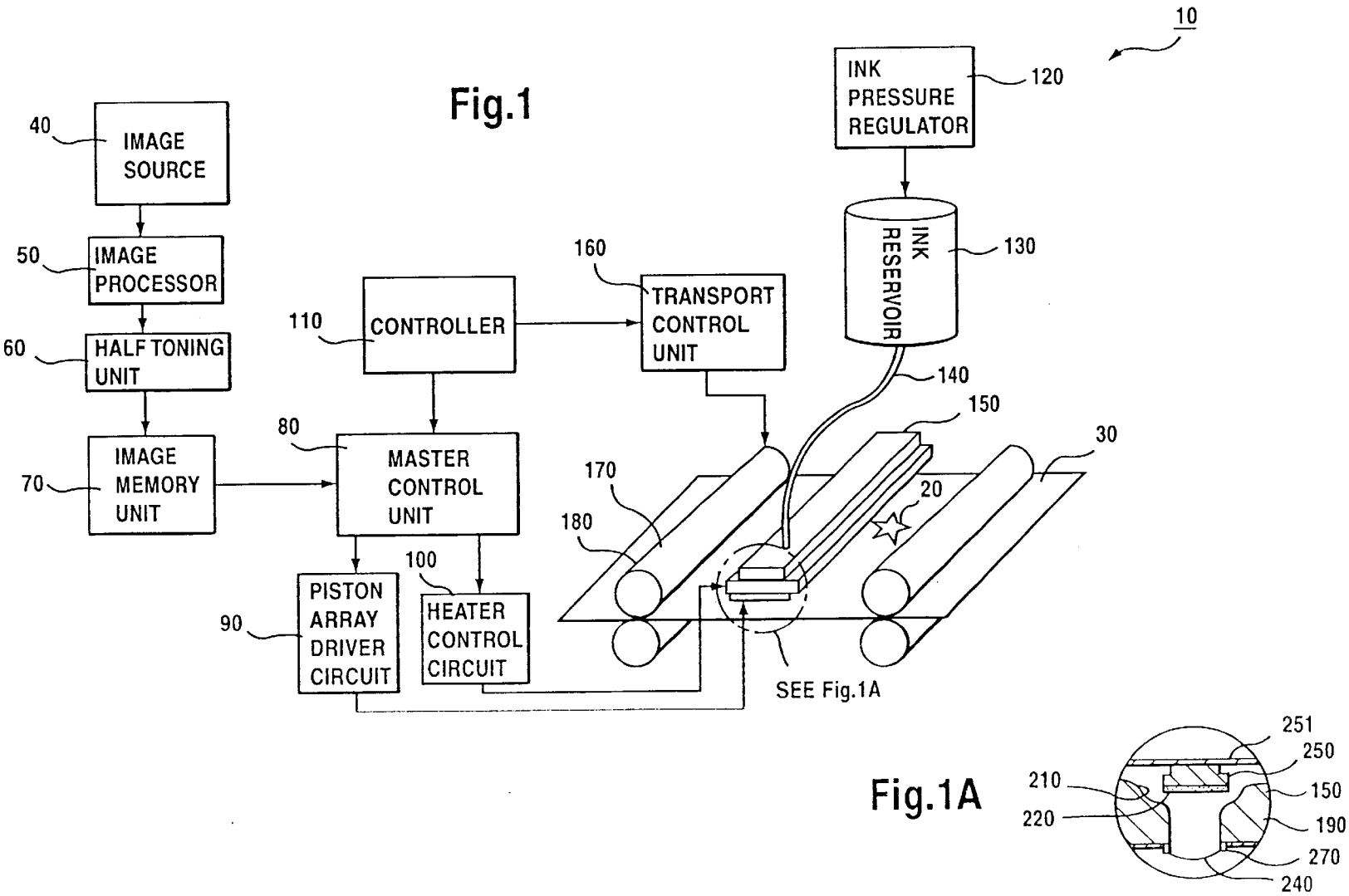
FIG. 1 shows a functional block diagram of an image forming system of the present invention including a first embodiment printhead.

Therefore, referring to FIG. 1, there is shown a functional block diagram of an image forming system, generally referred to as 10, for forming an image 20 on a recording medium 30. Recording medium 30 may be, for example, cut sheets of paper or transparency. System 10 comprises an input image source 40, which may be raster image data from a scanner (not shown) or computer (also not shown), or outline image data in the form of a PDL (Page Description Language) or other form of digital image representation. Image source 40 is connected to an image processor 50, which converts the image data to a pixel-mapped page image comprising continuous tone data. Image processor 50 is in turn connected to a digital halftoning unit 60 which halftones the continuous tone data produced by image processor 50. This halftoned bitmap image data is temporarily stored in an image memory unit 70 connected to halftoning unit 60. Depending on the configuration selected for system 10, image memory unit 70 may be a full page memory or a so-called band memory. For reasons described more fully hereinbelow, output data from image memory unit 70 is read by a master control circuit 80, which controls both a piston array driver circuit 90 and a heater control circuit 100.

Referring again to FIG. 1, system 10 further comprises a micro-controller 110 connected to master control circuit 80 for controlling master control circuit 80. As previously mentioned, control circuit 80 in turn controls piston array in driver circuit 90 and heater control circuit 100. Controller 110 is also connected to an ink pressure regulator 120 for controlling regulator 120. A purpose of regulator 120 is to regulate pressure in an ink reservoir 130 connected to regulator 120, which reservoir 130 contains a reservoir of ink therein for marking recording medium 30. Ink reservoir 130 is connected, such as by means of a conduit 140, to a printhead 150, which may be a DOD inkjet printhead. In addition, connected to controller 110 is a transport control unit 160 for electronically controlling a recording medium transport mechanism 170. Transport mechanism 170 may include a plurality of motorized rollers 180 aligned with printhead 150 and adapted to intimately engage recording medium 30. In this regard, rollers 180 rotatably engage recording medium 30 for transporting recording medium 30 past printhead 150. It may be understood that for the purpose of so-called "pagewidth" printing, printhead 150 remains stationary and recording medium 30 is moved past stationary printhead 150. On the other hand, for the purpose of so-called "scanning-type" printing, printhead 150 is moved along one axis (in a sub-scanning direction) and recording medium 30 is moved along an orthogonal axis (in a main scanning direction), so as to obtain relative raster motion.

Figure 2:
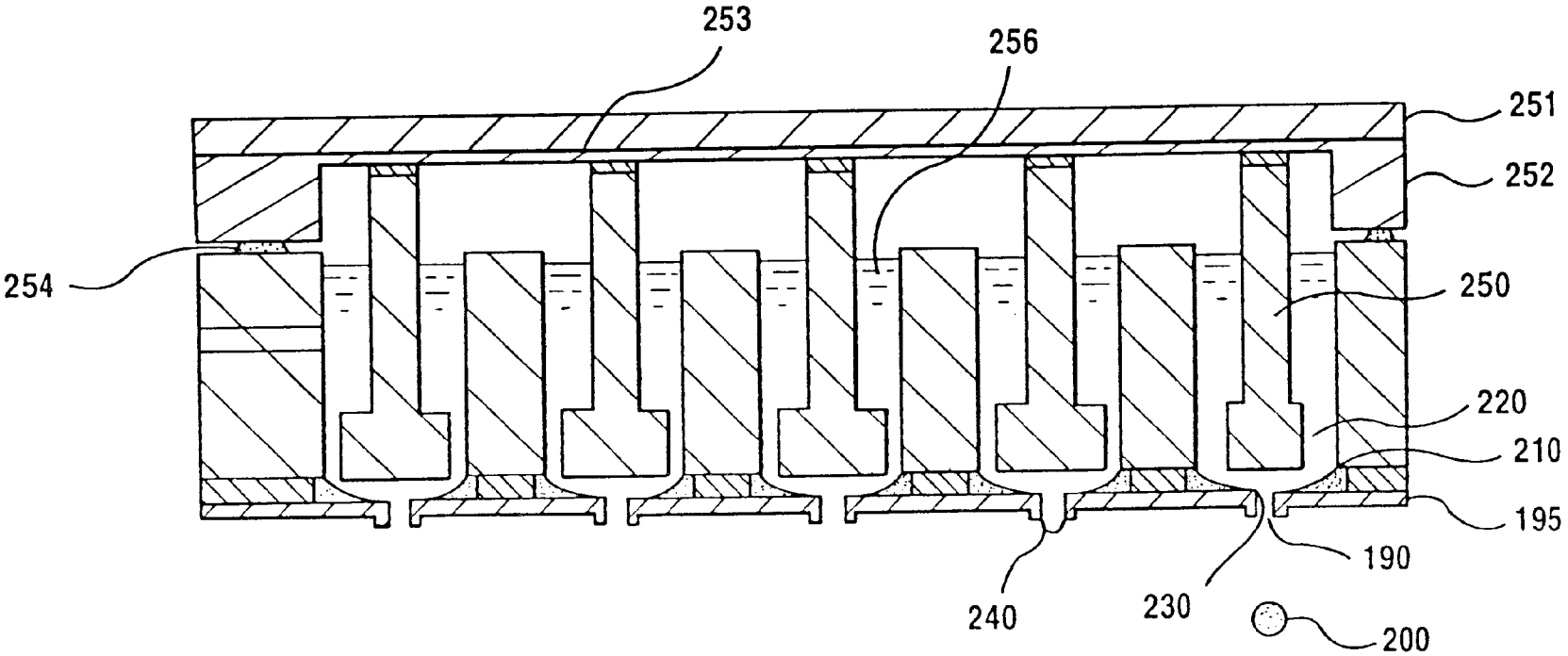
FIG. 2 is a view in vertical section of the printhead including a plurality of ink channels formed therein, each channel having a micromachined ink channel piston therein for pressurizing and depressurizing the ink channel.

Turning now to FIG. 2, printhead 150 comprises an array of micromachined ink channel pistons 250 positioned above nozzles 190, each nozzle 190 capable of ejecting ink droplet 200. Each nozzle 190 is etched in an orifice plate or substrate 195, which may be silicon, and defines a channel shaped chamber 210 in nozzle 190. Chamber 210 is in communication with reservoir 130, such as by means of previously mentioned conduit 140, for receiving ink from reservoir 130. In this manner, ink flows through conduit 140 and into chamber 210 such that an ink body 220 is formed in chamber 210. In addition, nozzle 190 defines a nozzle orifice 230 communicating with chamber 210. By way of example only and not by way of limitation, orifice 230 may have a radius of approximately 8 $\mu$m. Pistons 250 are actuated by the vertical movement of a motive source 251 via the movement of a plate 252 and membrane 253 covering the top of printhead 150. It may be appreciated that the ink covers a shaft portion of piston 250, but not does not touch the inside portion of plate 252 and membrane 253. Downward movement can be provided by an elastic seal 254 interconnecting plate 252 and body of print head 150.

Figure 3:
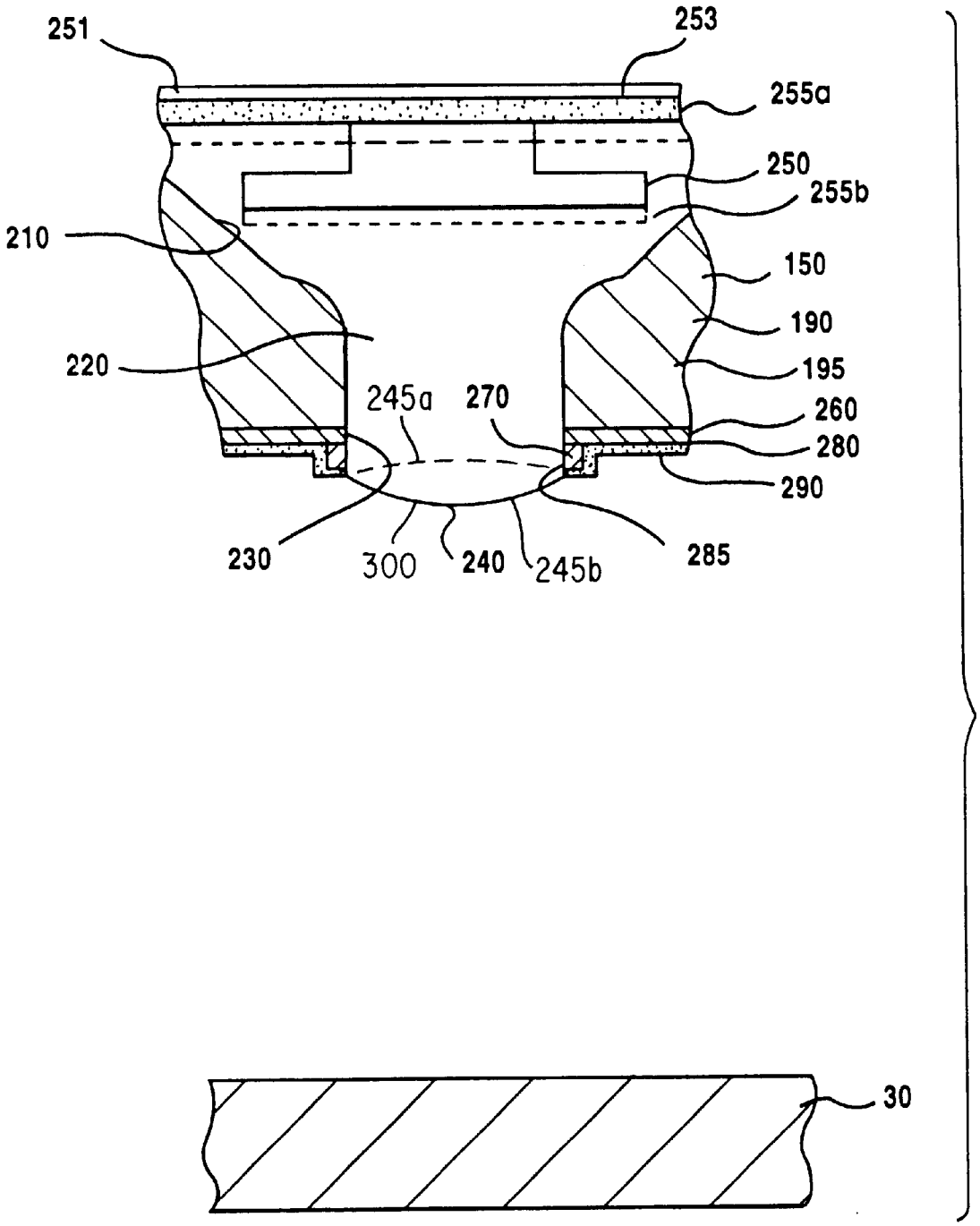
FIG. 3 is a view in vertical section of a printhead associated with each channel, the nozzle having an ink body therein and an ink meniscus connected to the ink body.
Figure 7:
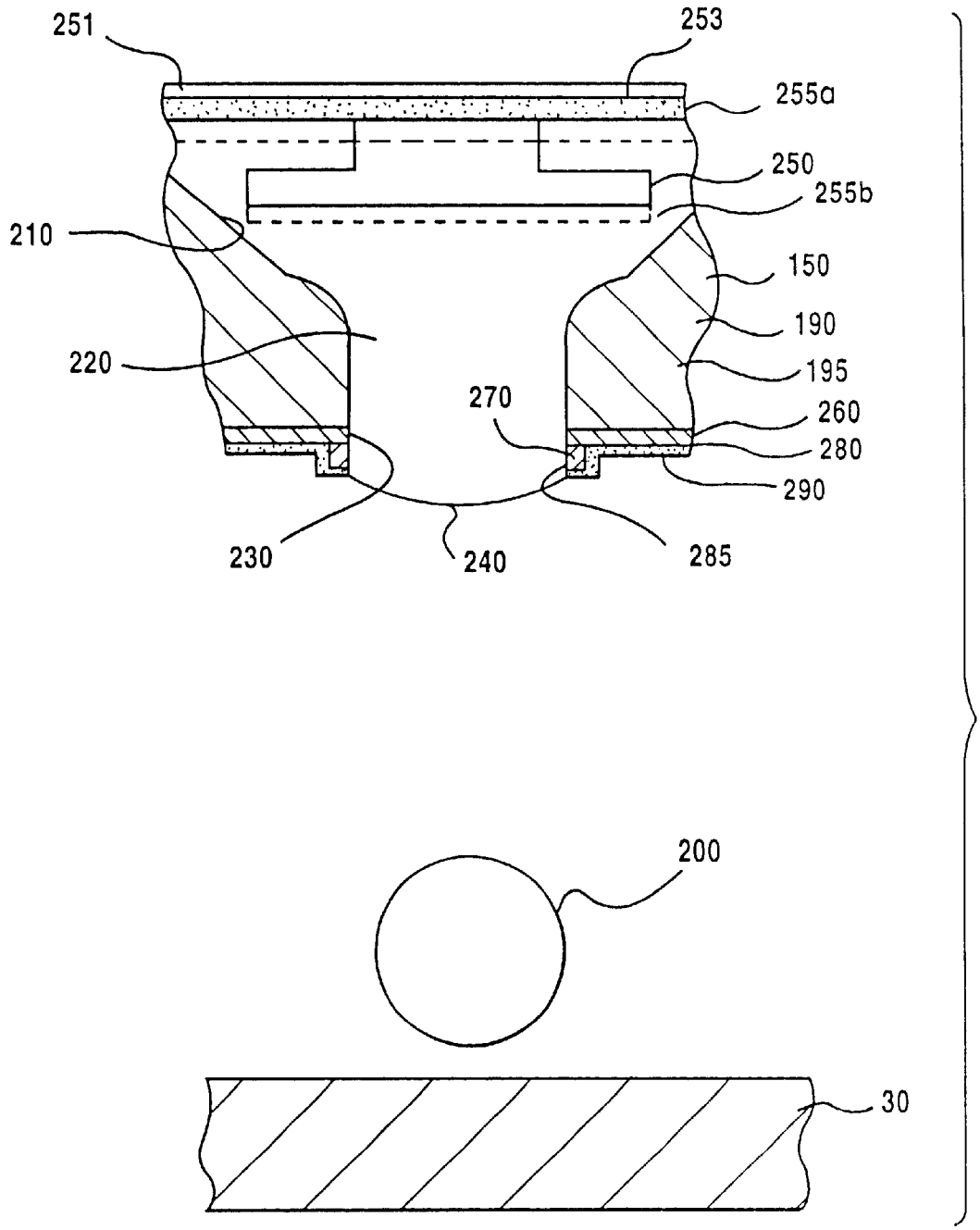
FIG. 7 is a view in vertical section of the nozzle, the meniscus having been severed from the nozzle so as to define a generally spherically-shaped ink droplet traveling toward a recording medium.

Referring to FIG. 3, each piston 250 is positioned above its respective nozzle 190. Of course, each nozzle 190 is capable of ejecting ink droplet 200 (see FIG. 7) therefrom to be intercepted by recording medium 30. In addition, nozzle 190 defines a nozzle orifice 230 communicating with chamber 210. An ink meniscus 240 is disposed at orifice 230 when ink body 220 is disposed in chamber 210.

Referring again to FIG. 3, in the absence of an applied heat pulse, meniscus 240 is capable of oscillating between a first position 245*a* (shown, for example, as a dashed curved line) and an extended meniscus second position 245*b*. It may be appreciated that, in order for meniscus 240 to oscillate, ink body 220 must itself oscillate because meniscus 240 is integrally formed with ink body 220, which ink body 220 is a substantially incompressible fluid. To oscillate each ink body 220, piston 250, which is in fluid communication with ink body 220 in chambers 210, is moved in a vertical direction by motive source 251. Motive source 251 may be formed of a piezoelectric material capable of accepting, for example, a 25 volt, 50 $\mu$s square wave electrical pulse, although other pulse shapes, such as triangular or sinusoidal may be used, if desired. In any event, motive source 251 is capable of vertical movement so as to evince oscillatory motion on piston 250 from its unstressed position 255*a* to a downwardly position 255*b*. More specifically, when piston 250 moves to downward position 255*b*, volume of chamber 210 decreases and meniscus 240 is extended outward from orifice 230 as shown by position 245*b*. Similarly, when piston 250 returns to its unstressed position 255*a*, volume of chamber 210 returns to its initial state and ink is retracted into nozzle with meniscus 240 returning to concave first position 245*a*. As described hereinabove, the movement of array of micromachined pistons 250 spans all chambers 210 and therefore simultaneously pressurizes and depressurizes all chambers 210 to confine the effects of pressure pulses produced by motion of motive source 251. These pressure effects are confined to each chamber 210 and are localized to its associated piston 250. In other words, the motion of motive source 251 produces a pressure pulse in a particular chamber 210 substantially due only to the motion of the piston 250 associated with that chamber and not, for example, with the motion of other pistons 250 associated with other chambers 210 or with the motion of plate 252. This is because ink covers only a portion of shaft 250 but does not touch inside portion of plate 252.

Still referring to FIG. 3, it is seen that as piston 250 is moved downwardly to position 255*b*, volume of chamber 210 decreases so that meniscus 240 extends from the orifice 230 as shown by position 245*b*. If the amplitude of the piston 250 motion is further increased by, for example, approximately 20%, necking of the meniscus occurs with ink drops separating from nozzles 190 during movement of piston 250 to its position 255*b*. With proper adjustment of the amplitude of oscillatory motion of piston 250, repeated extension and retraction of the meniscus 240 is possible without the separation of drops in the absence of a heat pulse. To ensure necking instability of meniscus 240 when a heat pulse is applied, the ink is formulated to have a surface tension which decreases with increasing temperature. Consequently, as described in detail hereinbelow, a heat pulse is applied to meniscus 240 to separate an ink droplet from nozzle 190.

Figure 4:
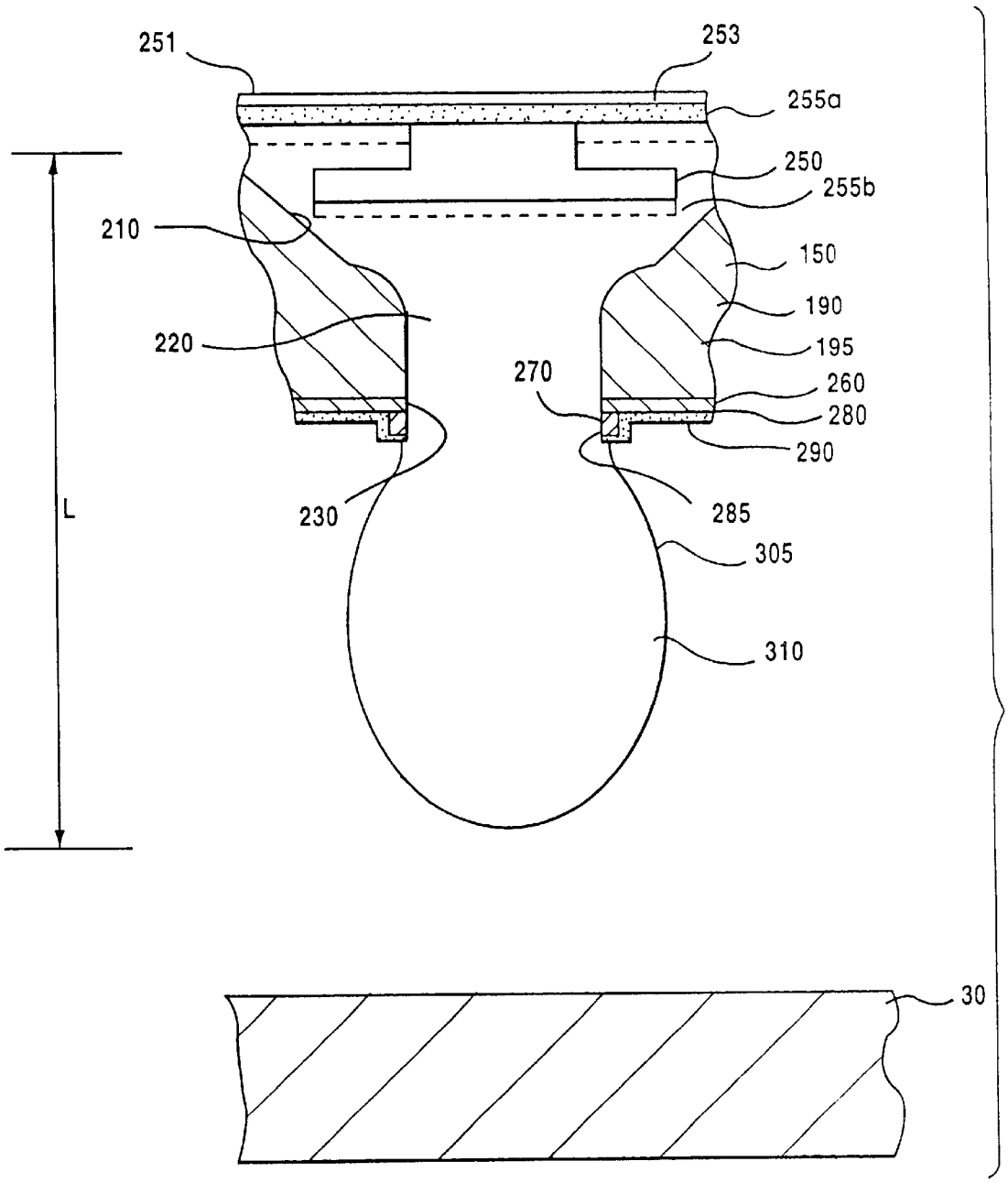
FIG. 4 is a view in vertical section of the printhead nozzle showing the ink meniscus outwardly extending from the nozzle, this view also showing a heater surrounding the nozzle and in heat transfer communication with the extended ink meniscus to lower surface tension of the extended ink meniscus in order to separate the extended ink meniscus from the nozzle.
Figure 5:
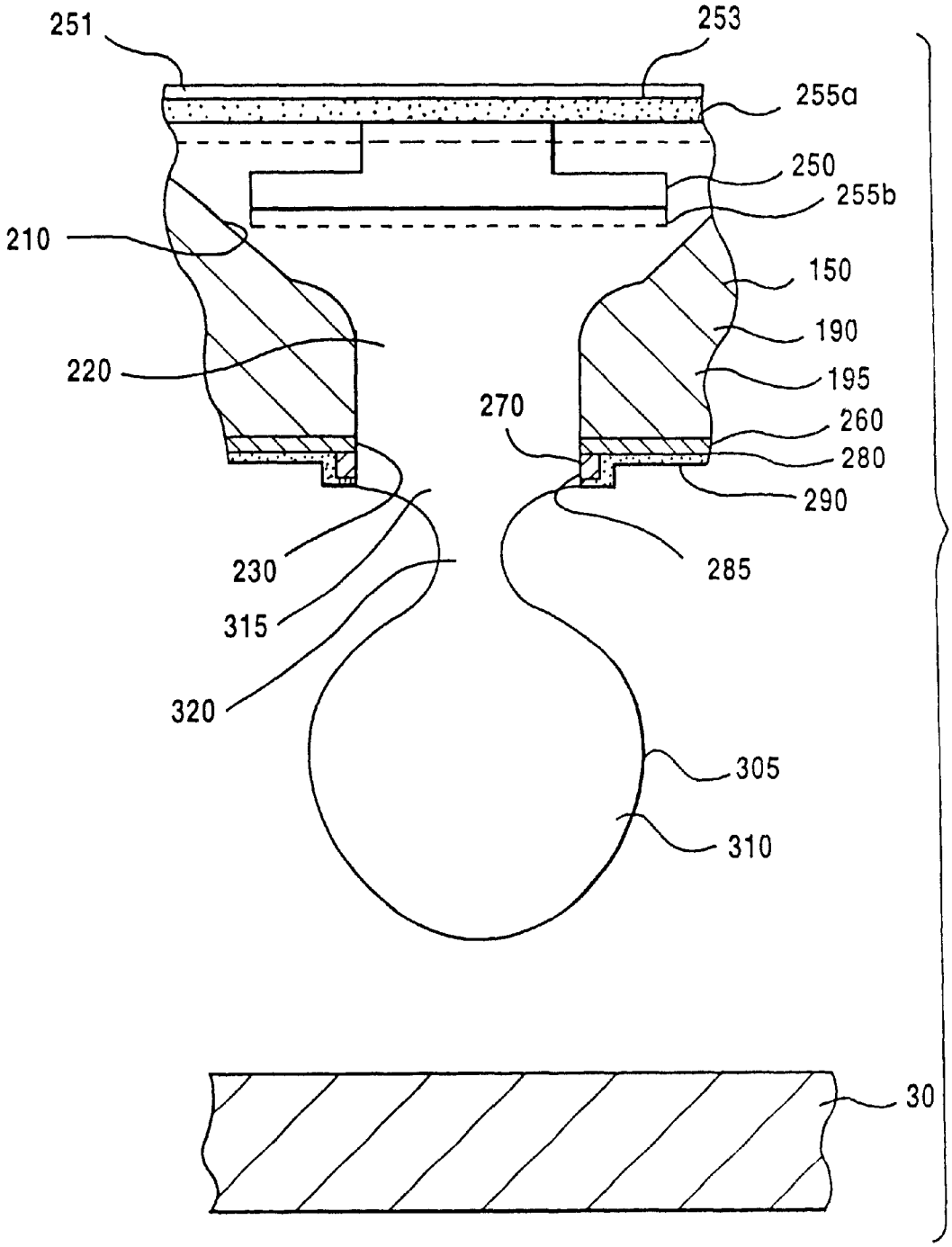
FIG. 5 is a view in vertical section of the nozzle having the meniscus further outwardly extending from the nozzle as the surface tension lowers.
Figure 6:
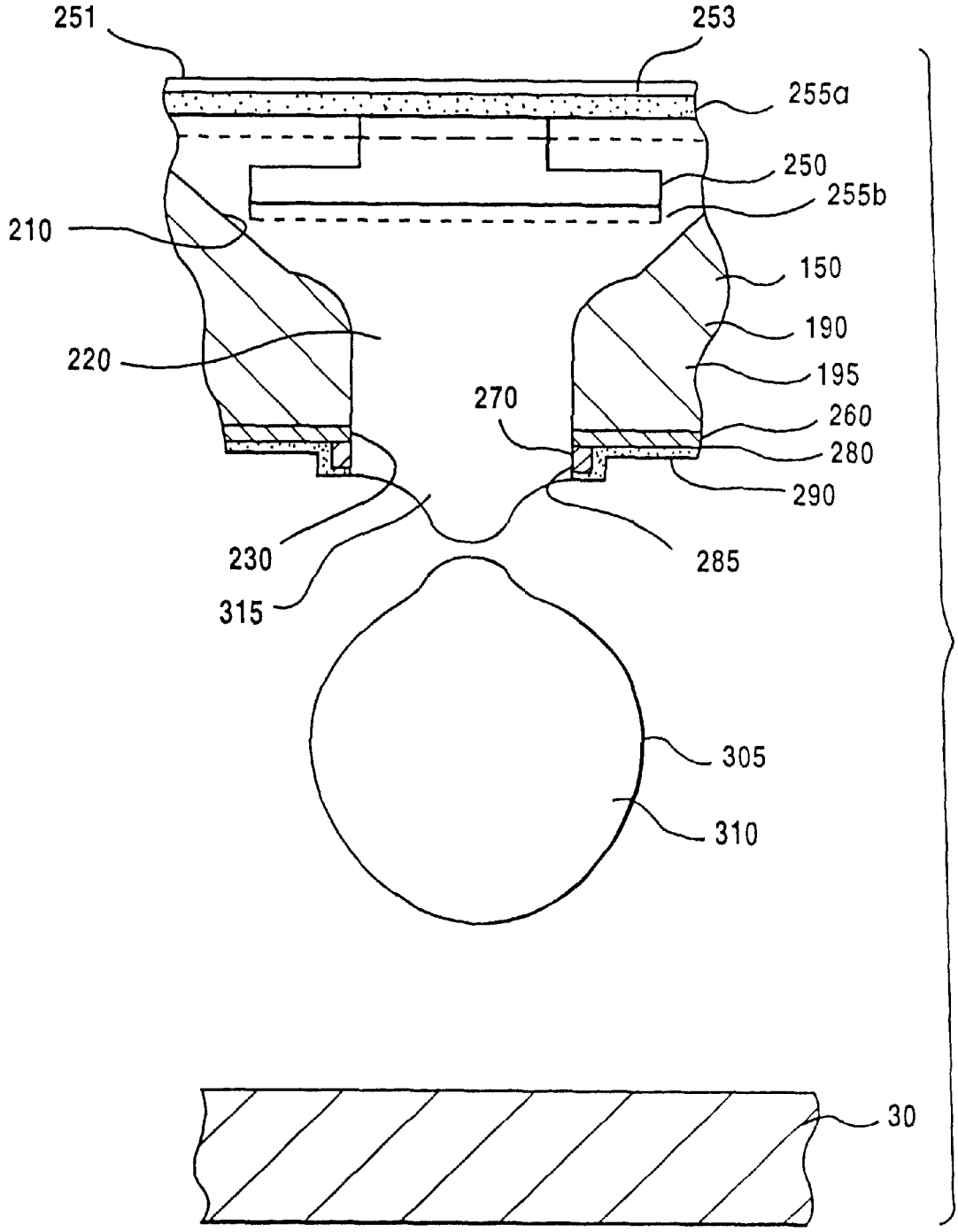
FIG. 6 is a view in vertical section of the nozzle, the meniscus shown in the act of severing from the nozzle and obtaining a generally oblong elliptical shape.

Therefore, as best seen in FIGS. 4, 5 and 6, an ink droplet separator, such as an annular heater 270, is provided for separating meniscus from orifice 230, so that droplet 200 leaves orifice 230 and travels to recording medium 30. More specifically, an intermediate layer 260, which may be formed from silicon dioxide, covers substrate 195. Heater 270 rests on substrate 195 and preferably is in fluid communication with meniscus 240 for separating meniscus 240 from nozzle 190 by lowering surface tension of meniscus 240. More specifically, annular heater 270 surrounds orifice 230 and is connected to a suitable electrode layer 280 which supplies electrical energy to heater 270, so that the temperature of heater 270 increases. Moreover, annular heater 270 forms a generally circular lip or orifice rim 285 encircling orifice 230. Although heater 270 is preferably annular, heater 270 may comprise one or more arcuate-shaped segments disposed adjacent to orifice 230, if desired. Heater 270 may advantageously comprise arcuate-shaped segments in order to provide directional control of the separated ink drop. By way of example only and not by way of limitation, heater 270 may be doped polysilicon. Also, by way of example only and not by way of limitation, heater 270 may be actuated for a time period of approximately 20 $\mu$s. Thus, intermediate layer 260 provides thermal and electrical insulation between heater 270 and electrode layer 280 on the one hand and electrical insulation between heater 270 and substrate 195 on the other hand. In addition, an exterior protective layer 290 is also provided for protecting substrate 195, heater 270, intermediate layer 260 and electrode layer 280 from damage by resisting corrosion and fouling. By way of example only and not by way of limitation, protective layer 290 may be polytetrafluroethylene chosen for its anti-corrosive and anti-fouling properties. In the above configuration, printhead 150 is relatively simple and inexpensive to fabricate and also easily integrated into a CMOS process.

Returning briefly to FIG. 1, piston array 250 and heater 270 are controlled by the previously mentioned piston array driver circuit 90 and heater control circuit 100, respectively. Piston array driver circuit 90 and heater control circuit 100 are in turn controlled by master control circuit 80. Master control circuit 80 controls piston array driver circuit 90 so that pistons 250 oscillate at a predetermined frequency. Moreover, master control circuit 80 reads data from image memory unit 70 and applies time-varying electrical pulses to predetermined ones of heaters 270 to selectively release droplets 200 in order to form ink marks at pre-selected locations on recording medium 30. It is in this manner that printhead 150 forms image 20 according to data that was temporarily stored in image memory unit 70.

Referring to FIGS. 3, 4, 5 and 7, meniscus 240 outwardly extends from orifice 230 to a maximum distance "L" before reversal of transducer 250 motion causes meniscus 240 to retract in the absence of a heat pulse. FIGS. 4 and 5 specifically depict the case in which a beat pulse is applied via heater 270 while the meniscus 240 is outwardly expanding. Timing of the heat pulse is controlled by heater control circuit 100. The application of heat by heater 270 causes a temperature rise of the ink in neck region 320. In this regard, temperature of neck region 230 is preferably greater than 100C but less than a temperature which would cause the ink to form a vapor bubble. Reduction in surface tension causes increased necking instability of the expanding meniscus 240 as depicted in FIG. 5. This increased necking instability, along with the reversal of motion of piston array 250 causes neck region 320 to break (i.e., sever). When this occurs, a new meniscus 240 forms after droplet separation and retracts into orifice 230. The momentum of the droplet 200 that is achieved is sufficient, with droplet velocities of 7 mlsec, to carry it to recording medium 30 for printing. The remaining newly formed ink meniscus 240 is retracted back into nozzle 190 as piston 250 returns to its first position 255*a*. This newly formed meniscus 240 can then be extended during the next cycle of motive source 251 and downward vertical movement of piston array 250. By way of example only and not by way of limitation, the total drop ejection cycle may be approximately 144 $\mu$s. In this manner, piston array motion and timing of heat pulses are electrically controlled by piston array driver circuit 90 and heater control circuit 100, respectively. Thus, it may be appreciated from the description hereinabove, that system 10 obtains a thermo-mechanically activated printhead 150 because heaters 270 supply thermal energy to meniscus 240 and piston array 250 supplies mechanical energy to meniscus 240 in order to produce droplet 200. The method of assembling the system and print head of present invention is described in detail hereinbelow with reference to FIGS. 8*a*–8*i*.

Figure 8A:
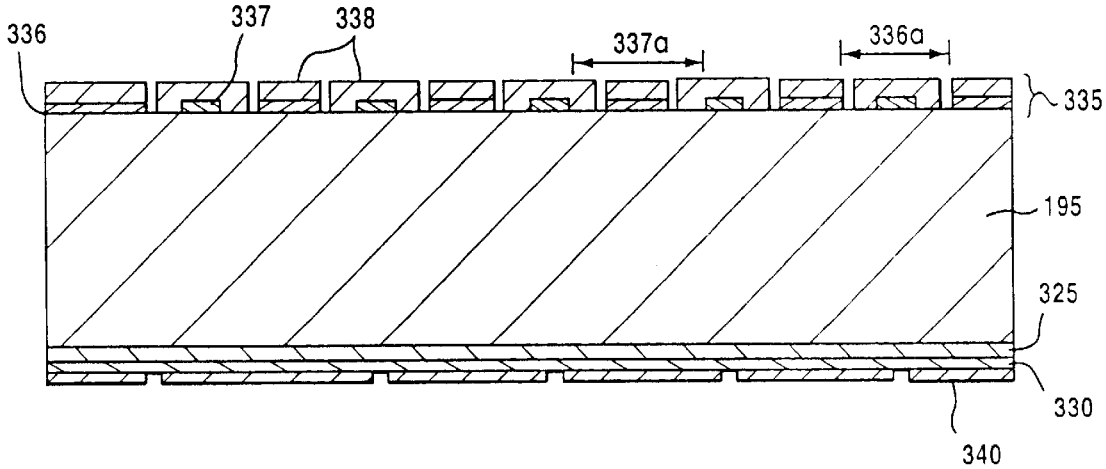
FIGS. 8*a*–8*i* are views in vertical section of the print head during assembly of the printhead.

Therefore, referring to FIG. 8*a*, substrate 195, which preferably is a silicon wafer, is shown having a sacrificial layer 325, preferably silicon oxide, and a nozzle plate layer 330, preferably nickel, deposited on a bottom side of substrate. A top mask 335 on a top surface of substrate 195 and a bottom mask 340 on the bottom surface of nozzle plate layer 330, have also been provided using a conventional lithography process and backside alignment techniques well known in the art of integrated circuit fabrication. Top mask 335 is a composite mask, known in the art of semiconductor processing, comprising in accord with the present invention, a mask 336 of a first material, preferably silicon oxide, having openings 336*a*, a second layer mask 337, formed of a second material, preferably silicon nitride, having openings 337*a*, and an optically patterned photoresist mask 338 having openings 338*a* overlying masks 337 and 336. Masks 336 and 337 are made preferably by the steps of first depositing a layer of silicon nitride, patterning this layer by conventional photolithography using photoresist and etching the layer to have openings 337*a*, removing the photoresist, then depositing a layer of silicon oxide and patterning this layer by etching to have openings 338*a*, the process of patterning in each case being accomplished by conventional photolithography and selective plasma etching, preferably reactive ion etching, as is well known in the art of semiconductor processing. Bottom mask 340, having openings 340*a*, is an optically patterned photoresist.

Figure 8B:
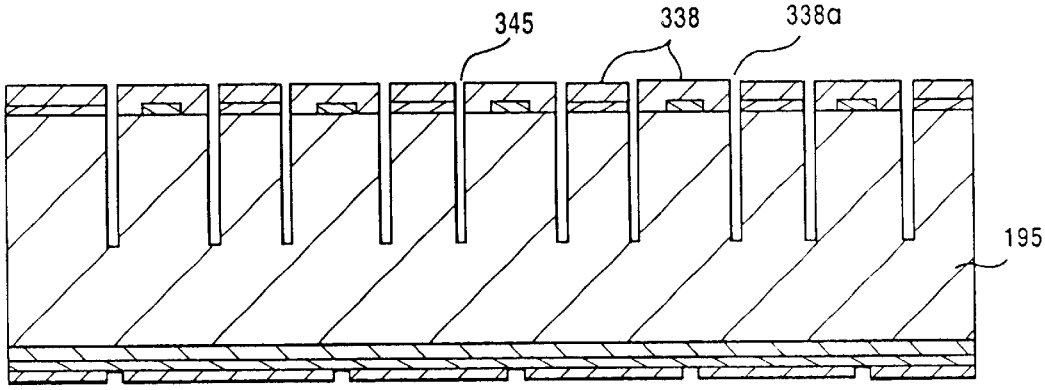
Figure 8C:
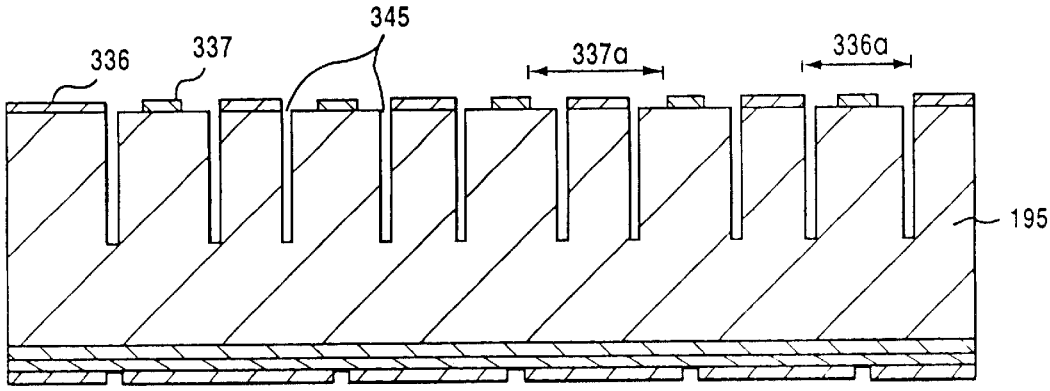
Figure 8D:
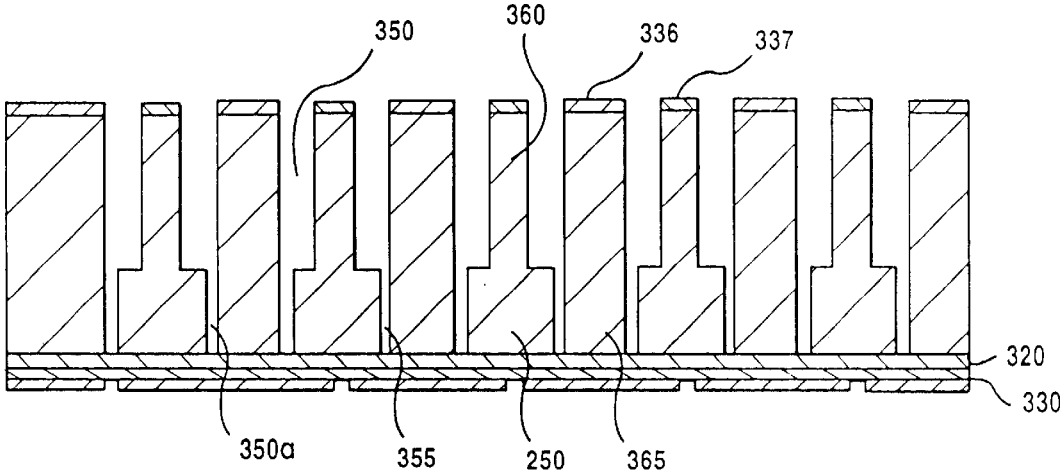
Figure 8E:
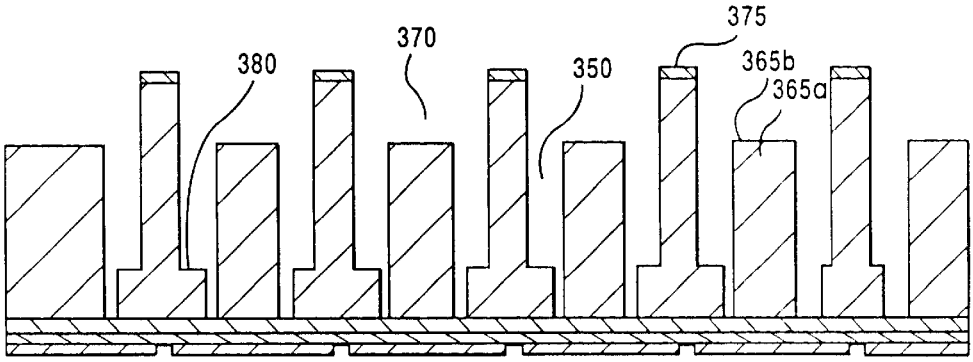

Referring now to in FIG. 8*b*, spacer trenches 345 are etched anisotropically into substrate 195, preferably silicon, by high density reactive ion etching. In the next step, mask 338 is removed, for example by exposure to an oxygen plasma (FIG. 8*c*).

With reference to FIG. 8*c*–8*i*, anisotropic silicon etching is continued, preferably again using the etching process previously used to define spacer trenches 345, until piston connection regions 350 have been formed. This process also forms piston clearance regions 350*a* which are simultaneously etched as extensions of spacer trenches 345. Piston defining trenches 355 may extend to the surface of sacrificial layer 325, although this is not required at this stage of processing. Pistons 250 with connecting shafts 360 and posts 365 are thereby formed, whereby piston defining trenches 355 extend to the surface of sacrificial layer 325.

Figure 8F:
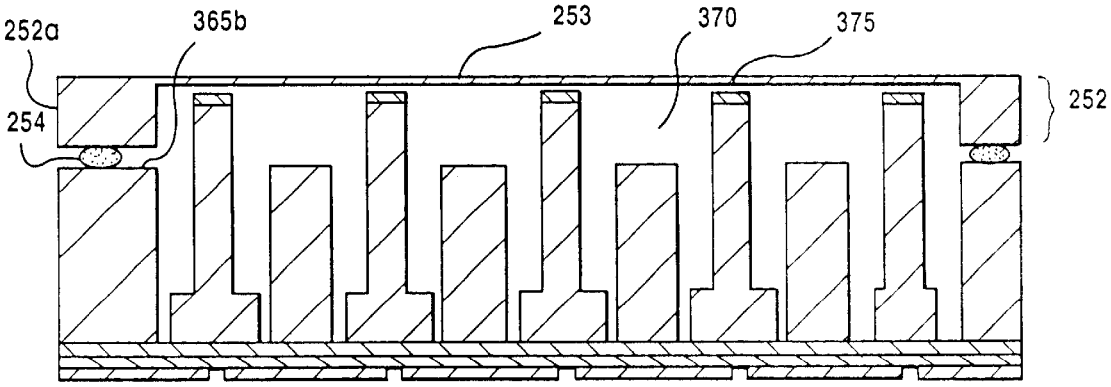
Figure 8G:
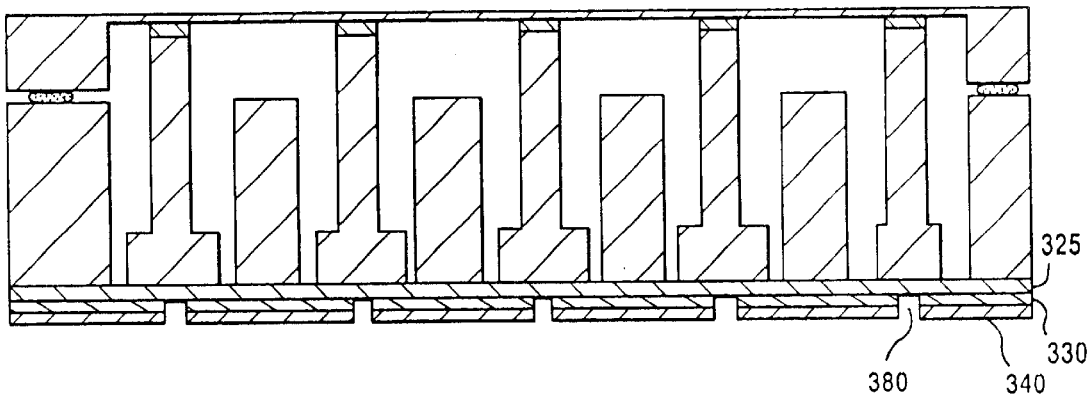

During the next step, mask 336 is removed, preferably by wet etching in the case when the material of mask 336 is silicon oxide. Anisotropic etching is continued, preferably using the process used to define spacer trenches 345. The continuation of anisotropic etching defines regions 370 (FIG. 8*e*) which, as will be described, contact ink piston connection regions 350 which are made deeper by this etch but not so deep as to contact sacrificial layer 325, and piston top surfaces 375. Posts 365 are thereby made shorter to become support posts 365*a* having top surfaces 365*b*. Plate 252, comprising edge regions 252*a* and membrane regions 253, as shown in FIG. 8*f*, is then assembled to selected top surfaces 365*b* of the regions 370 by flexible elastic seal 254, shown in FIG. 8*f* as a bead of a flexible material, for example silicon latex rubber, which allows the plate 252 to move vertically without distorting its shape. As shown in FIG. 8*g*, membrane 253 is attached to piston top surfaces 375, preferably by coating the membrane on its lower surface with a bonding material such as epoxy just prior to assembly of plate 252. At this stage, the bottom nozzle plate 330 is etched anisotropically to provide bore openings 380 in nozzle plate 330, for example by reactive ion etching from the bottom side of the structure.

Figure 8H:
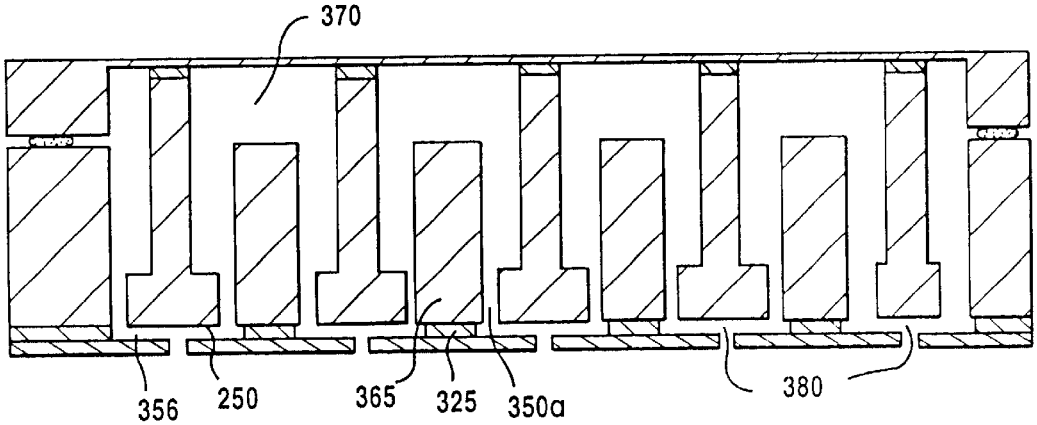
Figure 8I:
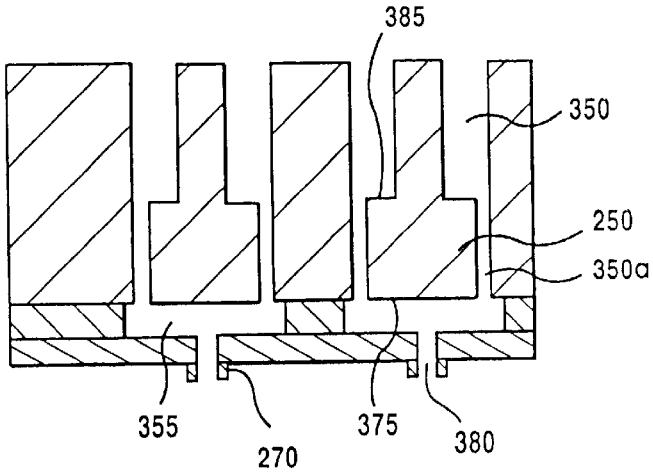

In the final step, FIG. 8*h*, an isotropic wet etch is used to remove sacrificial layer 325 in cavity regions 356 underlying the pistons 250 thereby forming a piston bottom surface 38*c*. As shown in FIG. 8*h*, this etch does not remove sacrificial layer 325 substantially under posts 365 because posts 365 are spaced from bore openings 380. Finally, FIG. 8I, heater rings 270 surrounding the bore regions on the nozzle plate surface are fabricated. The fabrication of heater rings is well known in the art of Micro Electro Mechanical Structures (MEMS). The heater rings 270 are preferably fabricated by the steps of deposition of a resistive layer, preferably polysilicon, and patterning of the layer into an annulus surrounding the openings 380. Alternatively, heater rings may be provided before etching bore openings 380.

In operating the piston array as a drop on demand inkjet printer, piston connection region 350, piston clearance region 350*a*, cavity region 356, bore openings 80, and a portion of ink region 370 are filled with ink 80, for example an aqueous based ink containing a dye. The filling is to an extent that the ink covers a portion of the piston shafts 360 but does not contact the bottom side of membrane 253. Thereby an ink meniscus 256 is formed below membrane 253 (FIG. 2) The ink may be pressurized by pressuring the air above the meniscus 256 to cause protrusion of drops of ink out of the bore openings 380 even in the absence of motion of the pistons 250, but this is not required for the operation of the device.

The use of a piston array is advantageously employed in accordance with the present invention to confine the effects of pressure pulses at cavity regions 356 produced by motion of membrane 253 to only those effect associated with corresponding pistons 250. In other words, motion of membrane 253 produces a pressure pulse at a particular cavity region 356 substantially due only to the motion of the piston 250 associated with that cavity and not, for example, with the motion of other pistons 250 associated with other cavities or with the motion of membrane 253 directly. In this regard, the preferred method of operation of the device is one in which the motion of the membrane 253 produces only localized pressure pulses a plurality of cavity regions 356, and does not, for example, produce pressure waves traveling with substantial energy throughout the ink or throughout portions of the substrate 195. This preferred method assures that the pressure pulses near any cavity region coming from any source other than the motion of the piston in that cavity region do not significantly alter the ejection of drops. The pressure pulses in all cavities are substantially identical providing the motion of each piston is the same. This is possible in accordance with the present invention because the piston shafts travel in a vertical direction and thereby couple their motion only weakly to the ink. The preferred method of operation of the device is one in which the motion of the membrane 253 does not produces pressure pulses in the ink by directly contacting the ink, since such pulses would spread to all cavity regions, as is well know in the art of acoustic coupling.

Figure 9:
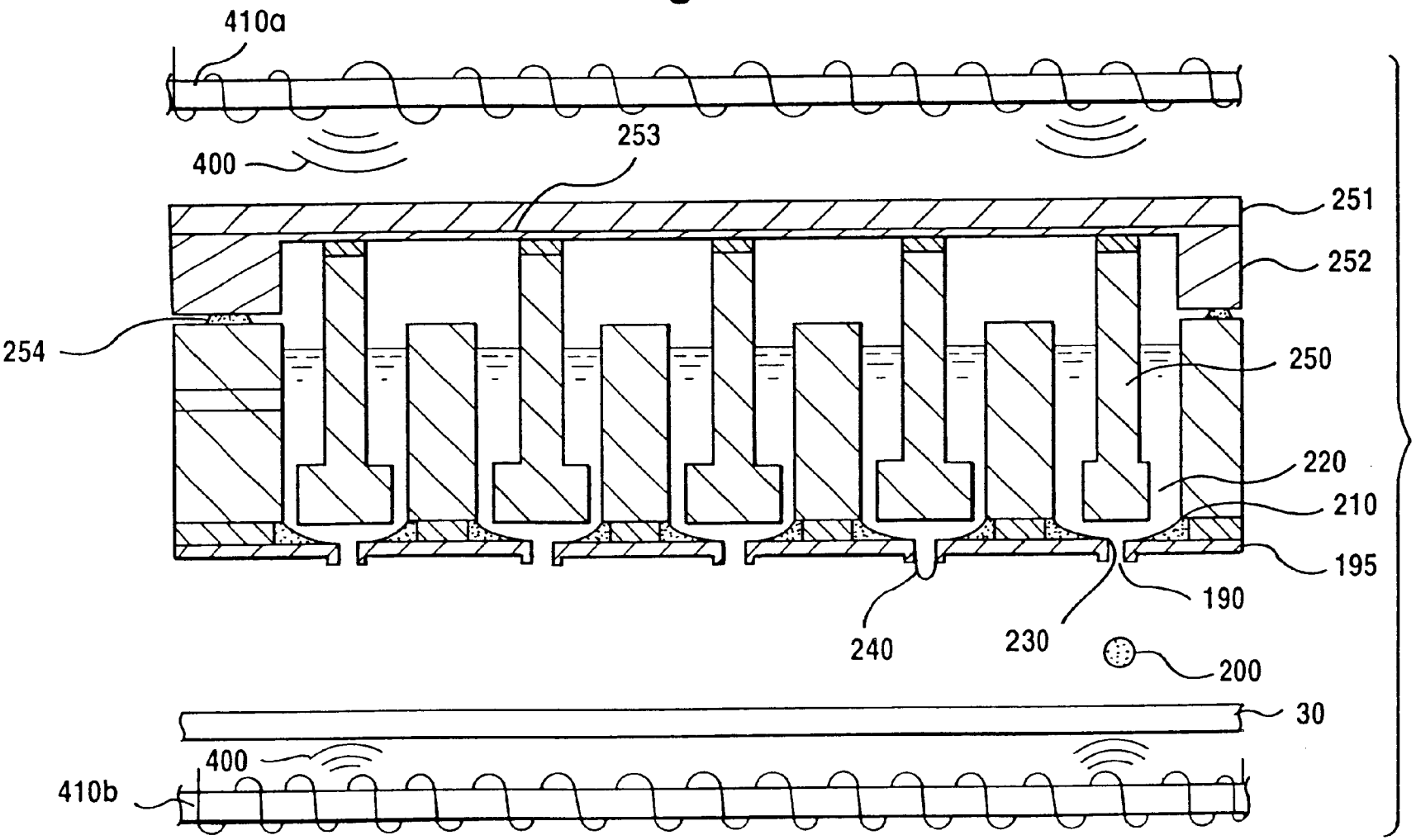
FIG. 9 is a view in vertical section of a second embodiment printhead belonging to the present invention.

Referring to FIG. 9, there is shown a second embodiment printhead 150. This second embodiment printhead is substantially similar to the first embodiment printhead, except that motive source 251 is formed of a metallic material that is responsive to an electromagnetic field 400. Electromagnetic field 400 is generated by each of a first electromagnet 410*a* and a second electromagnet 410*b* spaced-apart from first electromagnet 410*a* (as shown). Electromagnets 410*a*/*b* are operated out-of-phase for reasons disclosed presently. As second electromagnet 410*b* is operated, the first electromagnetic 410*a* is not operated. In this manner, electromagnetic field 400 emitted from second electromagnetic 410*b* will cause piston 250 to downwardly move in chamber 210, so that meniscus 240 extends from orifice 230. Similarly, as first electromagnet 410*a* is operated, the second electromagnet 410*b* is not operated. In this manner, electromagnetic field 400 emitted from first electromagnet 410*a* will cause piston 250 to upwardly move in chamber 210 to retract meniscus 240 into orifice 230.

Figure 10:
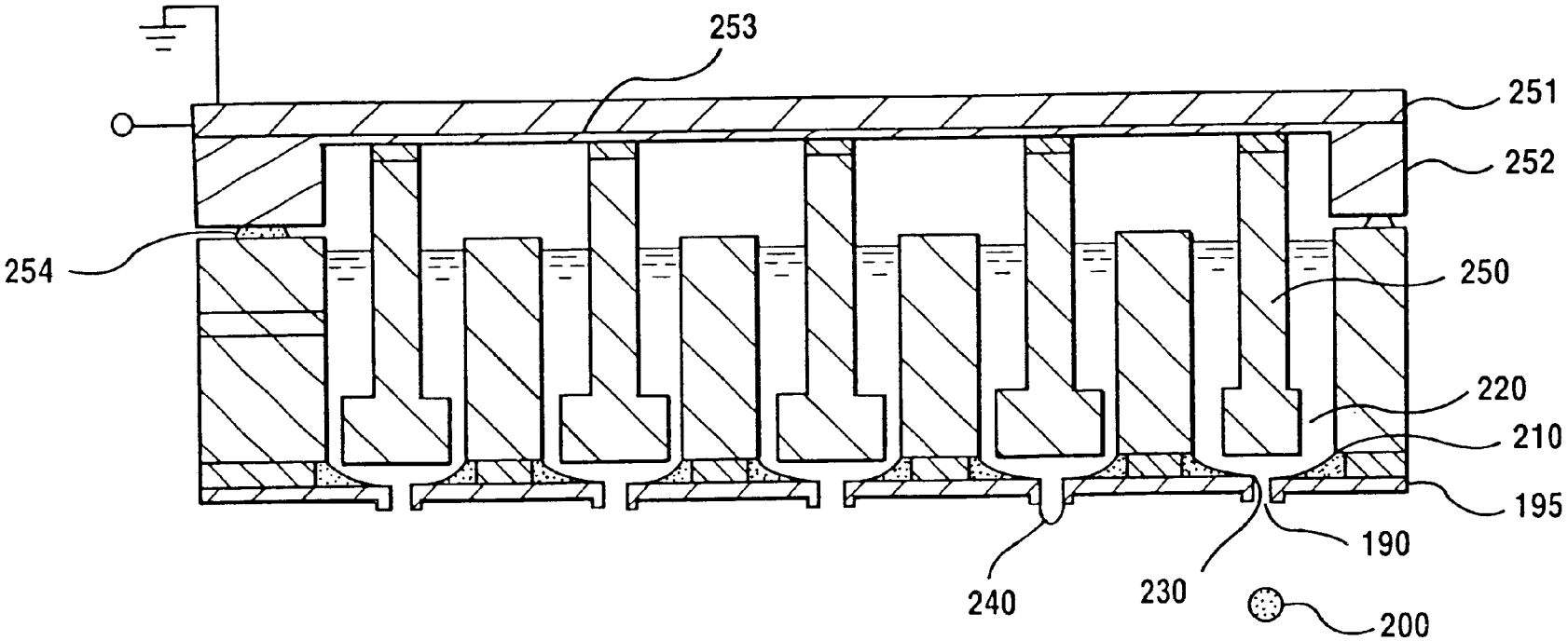
FIG. 10 is a view in vertical section of a third embodiment printhead belonging to the present invention.

Referring now to FIG. 10, a third embodiment printhead 150 is substantially similar to the first embodiment printhead, except that motive source 251 is formed of a piezoelectric material responsive to an electrical field, such that motive source 251 deflects when subjected to the electric field. In this regard, when motive source 251 is subjected to the electric field, piston 250 will deflect downwardly in chamber 210. Conversely, when the electric field ceases, piston 250 is caused to move upwardly in chamber 210 assisted by seal 254, as previously mentioned.

It may be appreciated from the teachings herein that an important aspect of the present invention is that a novel and unobvious technique is provided for significantly reducing the energy required to select which ink droplets to eject. This is achieved by separating the means for selecting ink drops from the means for ensuring that selected drops separate from the body of ink. Only the drop separation mechanism must be driven by individual signals supplied to each nozzle. In addition, the drop selection mechanism can be applied simultaneously to all nozzles.

It is understood from the teachings herein that an advantage of the resent invention is that there is no significant static back pressure acting on chamber 210 and ink body 220. Such static back pressure might otherwise cause inadvertent leakage of ink from orifice 230. Therefore, image forming system 10 has increased reliability by avoiding inadvertent leakage of ink.

Another advantage of the present invention is that the invention requires less heat energy than prior art thermal bubblejet printheads. This is so because the heater 270 is used to lower the surface tension of a small region (i.e., neck region 320) of the meniscus 240 rather than requiring latent heat of evaporation to form a vapor bubble. This is important for high density packing of nozzles so that heating of the substrate does not occur. Therefore, image forming system 10 uses less energy per nozzle than prior art devices.

Yet another advantage of the present invention is that heaters 270 are longer-lived because the low power levels that are used prevent cavitation damage due to collapse of vapor bubbles and kogation damage due to burned ink depositing on heater surfaces.

A further advantage of the present invention is that image resolution is increased compared to prior art devices. This is possible because transducer 250 does not in itself eject droplet 200; rather, piston 250 merely oscillates meniscus 240 so that meniscus 240 is pressurized and moves to position 245*a* in preparation for ejection. It is the lowering of surface tension by means of heater 270 that finally allows droplet 200 to be ejected. Use of piston 250 to merely oscillate meniscus 240 rather than to eject droplet 200 eliminates so-called "cross-talk" between chambers 210 during droplet ejection because the heat applied to the meniscus at one nozzle selected for actuation does not affect the meniscus at an adjacent nozzle. In other words, there is no significant heat transfer between adjacent nozzles. Elimination of cross-talk between chambers 210 allows more chambers 210 per unit volume of printhead 150. More chambers 210 per unit volume of printhead 150 results in a denser packing of chambers 210 in printhead 150, which in turn allows for higher image resolution.

An additional advantage of the present invention is that the velocity of the drop 200 of approximately 7 m/sec is large enough that no additional means of moving drops to recording medium 30 are necessary in contrast to prior art low energy use printing systems.

The invention has been described in detail with particular reference to certain preferred embodiments thereof, but it should be understood that variations and modifications can be effected within the spirit and scope of the invention. For example, ink body 220 need not be in a liquid state at room temperature. That is, solid "hot melt" inks can be used, if desired, by heating printhead 150 and reservoir 130 above the melting point of such a solid "hot melt" ink. As another example, system 10 may comprise a transducer and heater in combination with a surface tension reducing chemical agent injector mechanism in the same device, if desired. This chemical agent will assist in decreasing surface tension to enhance drop separation.

Therefore, what is provided is an image forming system and method for forming an image on a recording medium, the system including a printhead having a plurality of micromachined ink channel pistons, and method of assembling the system and print head.

PARTS LIST

L . . . maximum meniscus extension distance in absence of heating pulse
10 . . . image forming system
20 . . . image
30 . . . recording medium
40 . . . image source
50 . . . image processor
60 . . . halftoning unit
70 . . . image memory unit
80 . . . master control circuit
90 . . . piston array driver circuit
100 . . . heater control circuit
110 . . . controller
120 . . . ink pressure regulator
130 . . . ink reservoir
140 . . . conduit
150 . . . printhead
160 . . . transport control unit
170 . . . transport mechanism
180 . . . rollers
190 . . . nozzle
195 . . . substrate
200 . . . ink droplet
210 . . . chamber
220 . . . ink body
230 . . . nozzle orifice
240 . . . ink meniscus
245*a* . . . first position of meniscus
245*b* . . . second position of meniscus
250 . . . piston
251 . . . motive source
252 . . . plate
252*a* . . . edge region of plate
253 . . . membrane
254 . . . elastic seal
255*a* . . . first position of piston
255*b* . . . second position of piston
256 . . . meniscus
260 . . . intermediate layer
270 . . . heater
280 . . . electrode layer
285 . . . orifice rim
290 . . . protective layer
300 . . . surface area of ink meniscus
305 . . . expanded surface area of ink meniscus
310 . . . extended ink meniscus body
315 . . . posterior portion of extended ink meniscus body
320 . . . necked portion
325 . . . sacrificial layer
330 . . . nozzle plate layer
335 . . . top mask
336 . . . first part of top mask
336 . . . first part of top mask
338*a* . . .opening in top mask
337 . . . second part of top mask
337*a* . . . opening in second part of top mask
338. . . photoresist mask portion of top mask
340 . . . bottom mask
340*a* . . . opening in bottom mask
345 . . . spacer trench
350. . . piston connection region
350*a* . . . piston clearance region
355 . . . piston defining trench
356 . . . cavity region
360 . . . piston connecting shaft
365 . . . post
365*a* . . .support post
365*b* . . . top surface
370 . . . ink region
375 . . . piston top surface
380 . . . bore opening
385 . . . piston bottom surface
390 . . . channel
400 . . . electromagnetic field
410*a* . . . first electromagnetic
410*b* . . . second electromagnetic

What is claimed is:

1. An image forming system, comprising:

(a) a piston adapted to momentarily pressurize an ink body so that an ink meniscus extends from the ink body, the meniscus having a predetermined surface tension; and (b) an ink droplet separator associated with said piston for lowering the surface tension of the meniscus while the meniscus extends from the ink body;

(c) a motive source coupled to said piston for moving said piston wherein said motive source comprises:

(1) a member formed of a material responsive to an electromagnetic field; and (2) an electromagnet disposed near said member for applying the electromagnetic field to said member; and whereby said droplet separator separates the meniscus from the ink body to form an ink droplet while the surface tension lowers.

2. The system of claim 1, further comprising a motive source coupled to said piston for moving said piston.

3. The system of claim 2, wherein said motive source comprises:

(a) a member formed of a material responsive to an electromagnetic field; and (b) an electromagnet disposed near said member for applying the electromagnetic field to said member.

4. The system of claim 2, wherein said motive source comprises:

(a) a piezoelectric member responsive to an applied electric field; and (b) an electric field source disposed near said piezoelectric member for applying the electric field to said piezoelectric member.

5. The system of claim 1, wherein said droplet separator comprises a heater for heating a neck region of the meniscus.

6. The system of claim 5, further comprising a first control circuit connected to said heater for controlling said heater, so that said heater controllably heats the neck portion at a predetermined time.

7. The system of claim 1, further comprising a second control circuit connected to said piston for controlling said piston, so that said piston controllably pressurizes the ink body.

8. An inkjet image forming system, comprising;

(a) a nozzle defining a chamber therein for holding an ink body, said nozzle having a nozzle orifice in communication with the chamber, the orifice accommodating an ink meniscus of predetermined surface tension connected to the ink body;

(b) an oscillatable piston in fluid communication with the ink body for alternately pressurizing and depressurizing the ink body, so that the ink body oscillates as the ink body is alternately pressurized and depressurized and so that the meniscus extends and retracts as the ink body is respectively pressurized and depressurized;

(c) a droplet separator associated with said piston, said separator adapted to lower the surface tension of the meniscus while the meniscus extends from the orifice;

(d) an actuator coupled to said piston for actuating said piston, so that said piston oscillates, wherein said actuator comprises:

(1) a plate member formed of a material responsive to an electromagnetic field; and (2) an electromagnet disposed near said member for applying the electromagnetic field to said member; and whereby said separator lowers the surface tension of the meniscus as the meniscus extends from the orifice and whereby the meniscus separates from the orifice when the surface tension is lowered to a predetermined value.

9. The system of claim 8, wherein said droplet separator comprises a heater for heating a neck region of the meniscus.

10. The system of claim 9, further comprising a heater control circuit connected to said heater for controlling said heater, so that said heater controllably heats the neck region to effectuate separation of the meniscus form the ink body.

11. The system of claim 9, wherein said heater surrounds said nozzle.

12. The system of claim 8, further comprising a driver control circuit connected to said piston for controlling said piston, so that said piston controllably oscillates to alternately pressurize and depressurize the ink body.

13. A drop-on-demand inkjet image forming system for forming an image on a recording medium, comprising;

(a) a printhead;

(b) a plurality of nozzles integrally connected to said printhead, each nozzle defining a chamber therein for holding an ink body, each of said nozzles having a nozzle orifice in communication with respective ones of the chambers, each orifice accommodating an ink meniscus of predetermined surface tension connected to the ink body;

(c) a plurality of oscillatable pistons in fluid communication with respective ones of the ink bodies for alternately pressurizing and depressurizing the ink bodies, so that the ink bodies oscillate as the ink bodies are alternately pressurized and depressurized and so that the meniscus oscillate as the ink bodies oscillate;

(d) a plurality of heaters associated with respective ones of said pistons and in heat transfer communication with respective ones of the ink meniscus for lowering surface tension of the selected ones of the meniscus as the ink bodies are pressurized;

(e) an actuator coupled to said piston for actuating said piston, wherein said actuator comprises:

(1) a plate member formed of a material responsive to an electromagnetic field; and (2) an electromagnet disposed near said plate member for applying the electromagnetic field to said member; and (f) a heater control circuit connected to each of said heaters for actuating selected ones of said heaters, so that said selected ones of said heaters controllably heats the selected ones of the menisci, whereby each of the ink bodies oscillates as said piston oscillates, whereby each of the ink bodies is alternately pressurized and depressurized as each of the ink bodies oscillates, whereby each of the menisci oscillates as each of the ink bodies oscillates, whereby the surface tension of the selected ones of the menisci is lowered as the selected ones of the menisci are heated, whereby the selected ones of the menisci defines a neck portion thereof as the surface tension lowers to a predetermined value, whereby each of the neck portions sever as the surface tension lowers, and whereby the selected ones of the menisci separate from the orifices corresponding thereto as the neck portions thereof sever in order to from a plurality of ink droplets.

14. A drop on demand print head comprising:

(a) a plurality of drop-emitter nozzles each accommodating a body of ink associated with each of said nozzles;

(b) a plurality of pistons, each piston being associated with a respective nozzle and each piston adapted to subject ink in said body of ink to a pulsating pressure above ambient, to intermittently form an extended meniscus in each of all of said nozzles; and (c) a drop separator associated with each of all of said nozzles and selectively operable upon the meniscus of selected ones of said nozzles, when the meniscus is extended, to cause ink from each of the selected nozzles to separate as a drop from the body of ink, while allowing ink to be retained in non-selected nozzles without creation of a drop from each of the non-selected nozzles.

15. A method of operating an inkjet printhead comprising the steps of:

(a) providing a piston adapted to momentarily pressurize an ink body so that an ink meniscus extends from the ink body, the meniscus having a predetermined surface tension;

(b) providing an ink droplet separator in association with the piston for lowering the surface tension of the meniscus while the meniscus extends from the ink body, whereby the droplet separator separates the meniscus from the ink body to form an ink droplet while the surface tension lowers;

(c) operating a motive source connected to the piston for moving the piston, wherein the step of operating a motive source comprises the steps of:

(1) providing a member formed of a material responsive to an electromagnetic field; and (2) disposing an electromagnet near the member for applying the electromagnetic field to the member.

16. The method of claim 15, wherein the step of providing a droplet separator comprises the step of providing a heater for heating a neck region of the meniscus.

17. The method of claim 16, further comprising the step of connecting a first control circuit to the heater for controlling the heater, so that the heater controllably heats the neck portion at a predetermined time.

18. A method of assembling an inkjet image forming system, comprising the steps of;

(a) providing a nozzle defining a chamber therein for holding an ink body, the nozzle having a nozzle orifice in communication with the chamber, the orifice accommodating an ink meniscus of predetermined surface tension connected to the ink body;

(b) providing an oscillatable piston in fluid communication with the ink body for alternately pressurizing and depressurizing the ink body, so that the ink body oscillates as the ink body is alternately pressurized and depressurized and so that the meniscus extends and retracts as the ink body is respectively pressurized and depressurized;

(c) providing a droplet separator in association with the piston, the separator adapted to lower the surface tension of the meniscus while the meniscus extends from the orifice;

(d) coupling an actuator to the piston for actuating the piston, so that the piston oscillates, wherein the step of coupling an actuator comprises the steps of:

(1) providing a plate member formed of a material responsive to an electromagnetic field; and (2) disposing an electromagnet near the member for applying the electromagnetic field to the member, whereby the separator lowers the surface tension of the meniscus as the meniscus extends from the orifice and whereby the meniscus separates from the selected orifice when the surface tension is lowered to a predetermined value.

19. The method of claim 18, wherein the step of providing a droplet separator comprises the step of providing a heater for heating a neck region of the meniscus.

20. A method of assembling drop-on-demand inkjet image forming method for forming an image on a recording medium, comprising the steps of;

(a) providing a printhead;

(b) integrally connecting a plurality of nozzles to the printhead, each nozzle defining a chamber therein for holding an ink body, each of the nozzles having a nozzle orifice in communication with respective ones of the chambers, each orifice accommodating an ink meniscus of predetermined surface tension connected to the ink body;

(c) providing a plurality of oscillatable pistons in fluid communication with respective ones of the ink bodies for alternately pressurizing and depressurizing the ink bodies, so that the ink bodies oscillate as the ink bodies are alternately pressurized and depressurized and so that the menisic oscillate as the ink bodies oscillate;

(d) coupling an actuator to the piston for actuating the piston wherein the step of coupling an actuator comprises the step of:

(1) providing a plate member formed of a material responsive to an electromagnetic field; and (2) disposing an electromagnet near the member for applying the electromagnetic field to the member (e) providing a plurality of heaters in association with respective ones of the pistons and in heat transfer communication with respective ones of the ink menisic for lowering surface tension of the selected ones of the menisic as the ink bodies are pressurized; and (f) connecting a heater control circuit to each of the heaters for actuating selected ones of the heaters, so that the selected ones of the heaters controllably heats the selected ones of the menisic, whereby each of the ink bodies oscillates as the piston oscillates, whereby each of the ink bodies is alternately pressurized and depressurized as each of the ink bodies oscillates, whereby each of the menisic oscillates as each of the ink bodies oscillates, whereby the surface tension of the selected ones of the menisic is lowered as the selected ones of the menisic are heated, whereby the selected ones of the menisic defines a neck portion thereof as the surface tension lowers to a predetermined value, whereby each of the neck portions sever as the surface tension lowers, and whereby the selected ones of the menisic separate from the orifices corresponding thereto as the neck portions thereof sever in order to form a plurality of ink droplets.

21. The method of claim 20, wherein the step of providing a plurality of heaters comprises the step of providing a plurality of heaters surrounding respective ones of the nozzles for applying heat to the selected ones of the menisic and to the neck portions thereof.

22. A method of operating a drop on demand print head comprising the steps of:

(a) providing a plurality of drop-emitter nozzles for accommodating a body of ink associated with each of the nozzles;

(b) providing a plurality of pistons, each piston being associated with a respective one of the nozzles, all of the pistons being subject to oscillation to subject ink in the body of ink of each nozzle to a pulsating pressure above ambient, to intermittently form an extended meniscus in all of the nozzles; and (c) selectively heating the meniscus of predetermined selected ones of the nozzles but less than all of the nozzles when the meniscus is extended to cause ink from each of the selected nozzles to separate as drops from the body of ink, while allowing ink to be retained in non-selected nozzles without creation of drops from the non-selected nozzles.

23. The method according to claim 22 and wherein the pistons are connected to a member which is oscillated and the member oscillates in air with an air-ink interface being between the member which is oscillated and the bodies of the ink.

24. An image forming system, comprising:

(a) a piston adapted to momentarily pressurize an ink body so that an ink meniscus extends from the ink body, the meniscus having a predetermined surface tension; and (b) an ink droplet separator associated with said piston for lowering the surface tension of the meniscus while the meniscus extends from the ink body; wherein said motive source comprises:

(1) a piezoelectric member responsive to an applied electric field; and (2) an electric field source disposed near said piezoelectric member for applying the electric field to said piezoelectric member; and whereby said droplet separator separates the meniscus from the ink body to form an ink droplet while the surface tension lowers.

25. An inkjet image forming system, comprising;

(a) a nozzle defining a chamber therein for holding an ink body, said nozzle having a nozzle orifice in communication with the chamber, the orifice accommodating an ink meniscus of predetermined surface tension connected to the ink body;

(b) an oscillatable piston in fluid communication with the ink body for alternately pressurizing and depressurizing the ink body, so that the ink body oscillates as the ink body is alternately pressurized and depressurized and so that the meniscus extends and retracts as the ink body is respectively pressurized and depressurized; and (c) a droplet separator associated with said piston, said separator adapted to lower the surface tension of the meniscus while the meniscus extends from the orifice, (d) an actuator coupled to said piston for actuating said piston, so that said piston oscillates wherein said actuator comprises:

(1) a piezoelectric member responsive to an applied electric field; and (2) an electric field source disposed near said piezoelectric member for applying the electric field to said piezoelectric member.

26. A drop-on-demand inkjet image forming system for forming an image on a recording medium, comprising;

(a) a printhead;

(b) a plurality of nozzles integrally connected to said printhead, each nozzle defining a chamber therein for holding an ink body, each of said nozzles having a nozzle orifice in communication with respective ones of the chambers, each orifice accommodating an ink meniscus of predetermined surface tension connected to the ink body;

(c) a plurality of oscillatable pistons in fluid communication with respective ones of the ink bodies for alternately pressurizing and depressurizing the ink bodies, so that the ink bodies oscillate as the ink bodies are alternately pressurized and depressurized and so that the meniscus oscillate as the ink bodies oscillate;

(d) a plurality of heaters associated with respective ones of said pistons and in heat transfer communication with respective ones of the ink menisic for lowering surface tension of the selected ones of the menisic as the ink bodies are pressurized;

(e) an actuator coupled to said piston for actuating said piston, said actuator comprising:

(1) a piezoelectric member responsive to an applied electric field; and (2) an electric field source disposed near said piezoelectric member for applying the electric field to said piezoelectric member; and (f) a heater control circuit connected to each of said heaters for actuating selected ones of said heaters, so that said selected ones of said heaters controllably heats the selected ones of the menisic, whereby each of the ink bodies oscillates as said piston oscillates, whereby each of the ink bodies is alternately pressurized and depressurized as each of the ink bodies oscillates, whereby each of the menisic oscillates as each of the ink bodies oscillates, whereby the surface tension of the selected ones of the menisic is lowered as the selected ones of the menisic are heated, whereby the selected ones of the menisic defines a neck portion thereof as the surface tension lowers to a predetermined value, whereby each of the neck portions sever as the surface tension lowers, and whereby the selected ones of the menisic separate from the orifices corresponding thereto as the neck portions thereof sever in order to form a plurality of ink droplets.

27. The system of claim 26, wherein said heaters surround respective ones of said nozzles for applying heat to the selected ones of the menisic and to the neck portions thereof.

28. The system of claim 26, wherein said heater control circuit controls each of said heaters, so that heat is applied to the neck portions at a predetermined time after pressurization of said ink bodies.

29. The system of claim 26, wherein said heater control circuit controls each of said heaters, so that heat is applied to the neck portions at a time immediately preceding maximum outwardly extension of the selected ones of the menisic from the orifices.

30. The system of claim 26, further comprising a driver control circuit connected to said piston for controlling said piston, so that said piston controllably oscillates to alternately pressurize and depressurize the ink bodies.

31. A method of operating an inkjet printhead comprising the steps of:

(a) providing a piston adapted to momentarily pressurize an ink body so that an ink meniscus extends from the ink body, the meniscus having a predetermined surface tension;

(b) providing an ink droplet separator in association with the piston for lowering the surface tension of the meniscus while the meniscus extends from the ink body, whereby the droplet separator separates the meniscus from the ink body to form an ink droplet while the surface tension lowers;

(c) operating a motive source connected to the piston for moving the piston, wherein the step of operating a motive source comprises the steps of:

(1) providing a piezoelectric member responsive to an applied electric field; and (2) disposing an electric field source near the piezoelectric member for applying the electric field to the piezoelectric member.

32. A method of assembling an inkjet image forming system, comprising the steps of;

(a) providing a nozzle defining a chamber therein for holding an ink body, the nozzle having a nozzle orifice in communication with the chamber, the orifice accommodating an ink meniscus of predetermined surface tension connected to the ink body;

(b) providing an oscillatable piston in fluid communication with the ink body for alternately pressurizing and depressurizing the ink body, so that the ink body oscillates as the ink body is alternately pressurized and depressurized and so that the meniscus extends and retracts as the ink body is respectively pressurized and depressurized;

(c) providing a droplet separator in association with the piston, the separator adapted to lower the surface tension of the meniscus while the meniscus extends from the orifice;

(d) coupling an actuator to the piston for actuating the piston, so that the piston oscillates wherein the step of coupling an actuator comprises the steps of:

(1) providing a piezoelectric member responsive to an applied electric field; and (2) disposing an electric field source near the piezoelectric member for applying the electric field to the piezoelectric member; whereby the separator lowers the surface tension of the meniscus as the meniscus extends from the orifice and whereby the meniscus separates from the selected orifice when the surface tension is lowered to a predetermined value.

33. A method of assembling drop-on-demand inkjet image forming method for forming an image on a recording medium, comprising the steps of;

(a) providing a printhead;

(b) integrally connecting a plurality of nozzles to the printhead, each nozzle defining a chamber therein for holding an ink body, each of the nozzles having a nozzle orifice in communication with respective ones of the chambers, each orifice accommodating an ink meniscus of predetermined surface tension connected to the ink body;

(c) providing a plurality of oscillatable pistons in fluid communication with respective ones of the ink bodies for alternately pressurizing and depressurizing the ink bodies, so that the ink bodies oscillate as the ink bodies are alternately pressurized and depressurized and so that the meniscus oscillate as the ink bodies oscillate;

(d) coupling an actuator to the piston for actuating the piston wherein the step of coupling an actuator comprises the steps of:

(1) providing a piezoelectric member responsive to an applied electric field; and (2) disposing an electric field source near the piezoelectric member for applying the electric field to the piezoelectric member;

(e) providing a plurality of heaters in association with respective ones of the pistons and in heat transfer communication with respective ones of the ink menisic for lowering surface tension of the selected ones of the menisic as the ink bodies are pressurized; and (f) connecting a heater control circuit to each of the heaters for actuating selected ones of the heaters, so that the selected ones of the heaters controllably heats the selected ones of the menisic, whereby each of the ink bodies oscillates as the piston oscillates, whereby each of the ink bodies is alternately pressurized and depressurized as each of the ink bodies oscillates, whereby each of the menisic oscillates as each of the ink bodies oscillates, whereby the surface tension of the selected ones of the menisic is lowered as the selected ones of the menisic are heated, whereby the selected ones of the menisic defines a neck portion thereof as the surface tension lowers to a predetermined value, whereby each of the neck portions sever as the surface tension lowers, and whereby the selected ones of the menisic separate from the orifices corresponding thereto as the neck portions thereof sever in order to form a plurality of ink droplets.

34. A drop-on-demand inkjet image forming system for forming an image on a recording medium, comprising;

(a) a printhead;

(b) a plurality of nozzles integrally connected to said printhead, each nozzle defining a chamber therein for holding an ink body, each of said nozzles having a nozzle orifice in communication with respective ones of the chambers, each orifice accommodating an ink meniscus of predetermined surface tension connected to the ink body;

(c) a plurality of oscillatable pistons in fluid communication with respective ones of the ink bodies for alternately pressurizing and depressurizing the ink bodies, so that the ink bodies oscillate as the ink bodies are alternately pressurized and depressurized and so that the meniscus oscillate as the ink bodies oscillate;

(d) a heater associated respectively with each nozzle and in heat transfer communication with a respective ink meniscus formed at a respective nozzle orifice for changing surface tension of a selected meniscus as the ink bodies are pressurized and depressurized to extend and retract menisic; and (e) a heater control circuit connected to each of said heaters for actuating heaters of selected ones of said nozzles and not actuating heaters of non-selected others of said nozzles, so that said heaters of selected ones of said nozzles controllably heat the selected ones of the menisic, whereby as said piston oscillates each of the ink bodies is alternately pressurized and depressurized to cause the menisic to oscillate and whereby the surface tension of the selected ones of the menisic are changed as the selected ones of the menisic are heated, and whereby menisic of the selected ones of the nozzles separate from the respective orifices and are ejected from the orifices to form a plurality of ink droplets and non-selected nozzles have menisic which do not separate and are not ejected.

35. The inklet image forming system of claim 34 and wherein a plurality of the pistons are attached to an oscillating member that oscillates in air and there is an air-ink interface between the oscillating member and the ink bodies.

36. A drop-on-demand inkjet image forming method for forming an image on a recording medium, comprising;

(a) providing a printhead having a plurality of nozzles integrally connected to said printhead, each nozzle defining a chamber therein for holding an ink body, each of said nozzles having a nozzle orifice in communication with respective ones of the chambers, each orifice accommodating an ink meniscus of predetermined surface tension connected to the ink body;

(b) oscillating pistons in fluid communication with respective ones of the ink bodies to alternately pressurize and depressurize the ink bodies, so that the ink bodies oscillate as the ink bodies are alternately pressurized and depressurized and so that the meniscus oscillate as the ink bodies oscillate;

(c) providing a heater associated respectively with each nozzle and in heat transfer communication with a respective ink meniscus formed at a respective nozzle orifice for changing surface tension of a selected meniscus as the ink bodies are pressurized and depressurized to extend and retract menisic; and (d) actuating heaters of selected ones of said nozzles to heat the respective meniscus of selected nozzles which are fewer than all of said nozzles, whereby as said piston oscillates each of the ink bodies of all of said nozzles is alternately pressurized and depressurized to cause the menisic to oscillate and whereby the surface tension of the menisic of selected ones of nozzles are changed as the result of their being heated, and whereby menisic of the selected ones of the nozzles separate from the respective orifices and are ejected from the orifices to form a plurality of ink droplets and non-selected nozzles have menisic which do not separate and are not ejected.

37. The method of claim 36 and wherein a plurality of the pistons are attached to an oscillating member that oscillates in air and there is an air-ink interface between the oscillating member and the ink bodies.

38. The method of claim 37 and wherein the pistons are a micromachined array of pistons.

39. The method of claim 37 and wherein the heater includes arcuate-shaped segments to provide directional control of a droplet from an orifice.

40. The method of claim 37 wherein the heater heats a meniscus of a nozzle selected for ejecting a droplet to a temperature less than that which would cause ink to form a vapor bubble.

41. The method of claim 37 wherein momentum of an ejected droplet is sufficient to carry it to a recording medium for printing.

42. The method of claim 37 wherein air above the ink body is pressurized.

43. The method of claim 36 and wherein the pistons are a micromachined array of pistons.

44. The method of claim 36 and wherein the heater includes arcuate-shaped segments to provide directional control of a droplet from an orifice.

45. The method of claim 36 wherein the heater heats a meniscus of a nozzle selected for ejecting a droplet to a temperature less than that which would cause ink to form a vapor bubble.

46. The method of claim 36 wherein momentum of an ejected droplet is sufficient to carry it to a recording medium for printing.

47. The method of claim 36 wherein air above the ink body is pressurized.

* * * * *